US007299507B1

(12) United States Patent
Hermoso et al.

(10) Patent No.: US 7,299,507 B1
(45) Date of Patent: Nov. 27, 2007

(54) PROTECTIVE HARNESS FOR A MOTORCYCLE RIDER

(76) Inventors: Jeffery Hermoso, 409 W. Martinshire St., Carson, CA (US) 90745; Prospero Jun San Juan, 7181 Lemon Grass Ave., Corona, CA (US) 92880; Ulysses Garces, 16628 Woodruff Ave., Apt. #5, Bellflower, CA (US) 90706

( * ) Notice: Subject to any disclaimer, the term of this patent is extended or adjusted under 35 U.S.C. 154(b) by 0 days.

(21) Appl. No.: 11/355,759

(22) Filed: Feb. 15, 2006

Related U.S. Application Data

(60) Provisional application No. 60/652,913, filed on Feb. 15, 2005.

(51) Int. Cl.
*A41D 13/00* (2006.01)

(52) U.S. Cl. ..... 2/467

(58) Field of Classification Search ..... 2/102, 2/455, 456, 463–465, 467, 411, 413, 462, 2/DIG. 3; 441/88, 90, 92, 94, 96
See application file for complete search history.

(56) References Cited

U.S. PATENT DOCUMENTS

| | | | | |
|---|---|---|---|---|
| 4,825,469 | A * | 5/1989 | Kincheloe | 2/456 |
| 5,500,952 | A * | 3/1996 | Keyes | 2/465 |
| 5,746,442 | A * | 5/1998 | Hoyaukin | 280/730.1 |
| 6,546,561 | B2 * | 4/2003 | Duhamell | 2/102 |
| 6,859,939 | B1 * | 3/2005 | Osburn, Sr. | 2/69 |

* cited by examiner

*Primary Examiner*—Tejash Patel
(74) *Attorney, Agent, or Firm*—Kenneth L Tolar

(57) ABSTRACT

A protective harness for a motorcycle rider includes a back plate having an upper section hingedly attached to a lower section. Received within the upper section are an inflatable neck collar and a shoulder bladder. Received within the lower section is an inflatable rib cage bladder. If a rider is displaced from the motorcycle, a CO2 dispensing mechanism automatically inflates and deploys the bladders to encompass and protect the wearer's neck, rib cage and back.

10 Claims, 2 Drawing Sheets

PROTECTIVE HARNESS FOR A MOTORCYCLE RIDER

CROSS REFERENCE TO RELATED APPLICATIONS

This application is entitled to the benefit of provisional application No. 60/652,913 filed on Feb. 15, 2005, the specification of which is incorporated herein by reference.

BACKGROUND OF THE INVENTION

The present invention relates to a harness including a plurality of protective bladders that are automatically inflated if a rider is displaced from a motorcycle.

DESCRIPTION OF THE PRIOR ART

The danger associated with riding a motorcycle is well documented. Because the rider is often dismounted from the motorcycle during an accident, severe bodily injury can occur. Though most states require a rider to wear a protective helmet, such practice provides no protection whatsoever for the rider's back, spine, neck, rib cage and abdomen. Accordingly, there is currently a need for device that protects a motorcycle rider's body in the event of an accident. The present invention satisfies this need by providing a uniquely designed harness including multiple bladders that are automatically inflated upon the rider being ejected from the motorcycle.

SUMMARY OF THE INVENTION

The present invention relates to a protective harness for a motorcycle rider. The device comprises a back plate formed of upper and lower hinged sections having a waist strap attached to a lower end of the lower section. A pair of shoulder straps are secured to the back plate for further securing it to a wearer. Received within the upper back plate section are a neck bladder and a shoulder bladder. The neck bladder includes a collar that surrounds the wearer's neck to provide a protective, supportive barrier between the shoulders and head. The shoulder bladder, when completely inflated, forms an elongated, horizontal pad across the wearer's shoulder blades. Received within the lower back plate section is a rib cage bladder that, when inflated, forms an encompassing, protective barrier about the wearer's rib cage. The bladders are automatically inflated and deployed with a CO2 manifold system whenever a motorcycle rider is ejected from the motorcycle.

It is therefore an object of the present invention to provide a protective harness for a motorcycle rider that automatically inflates a plurality of bladders in the event of an accident.

It is another object of the present invention to provide a protective harness for a motorcycle rider that protects the neck, rib cage, spinal cord and similar areas of the rider's body.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
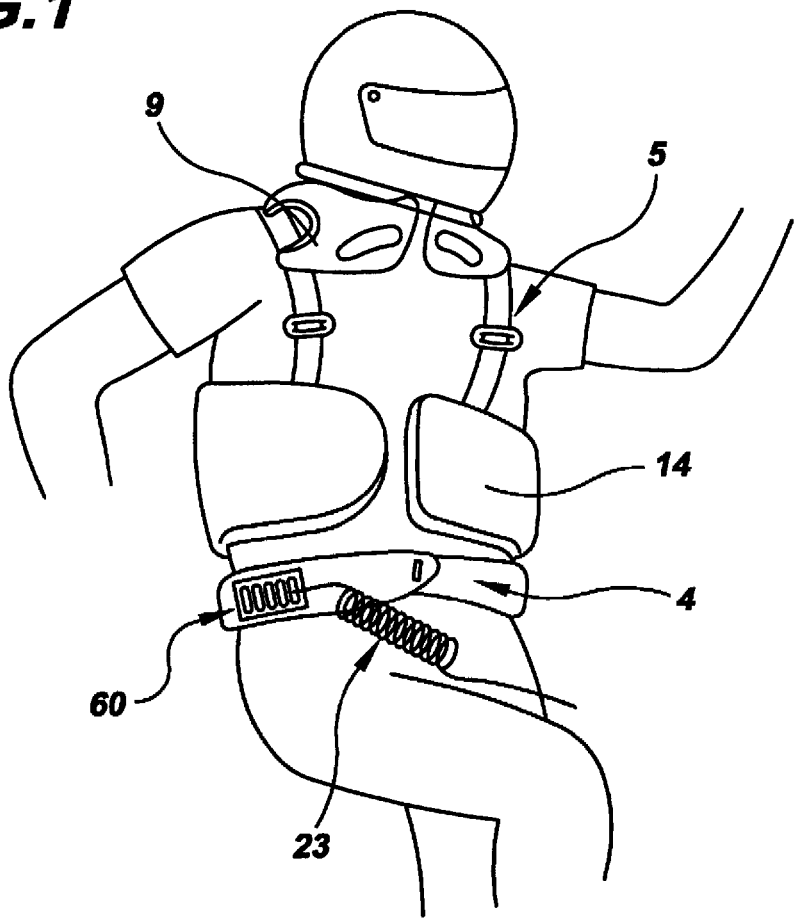
FIG. 1 is a perspective view of a rider wearing the harness with the bladders in a deployed, inflated configuration.
Figure 2:
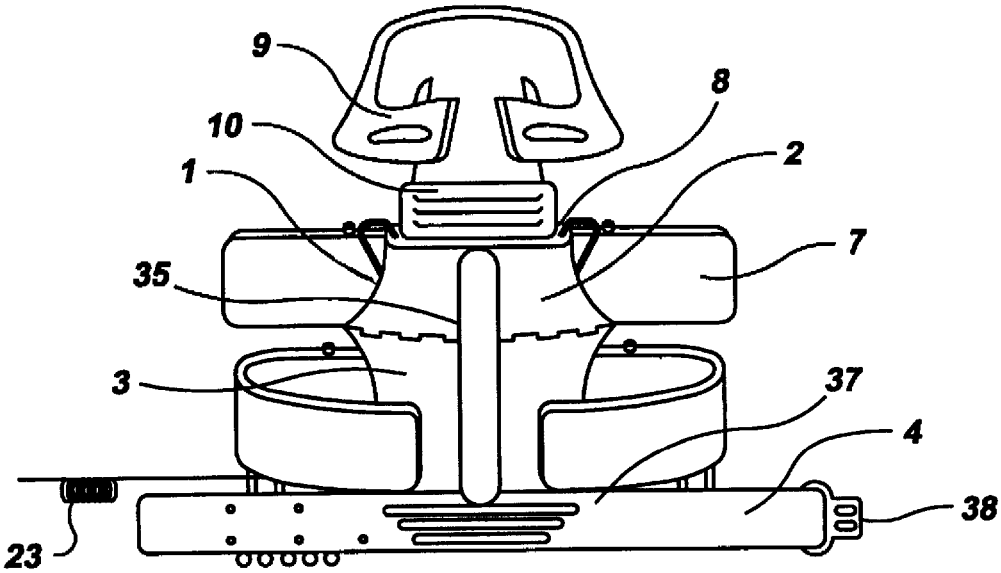
FIG. 2 is a front view of the harness with the bladders in a deployed, inflated configuration.
Figure 3:
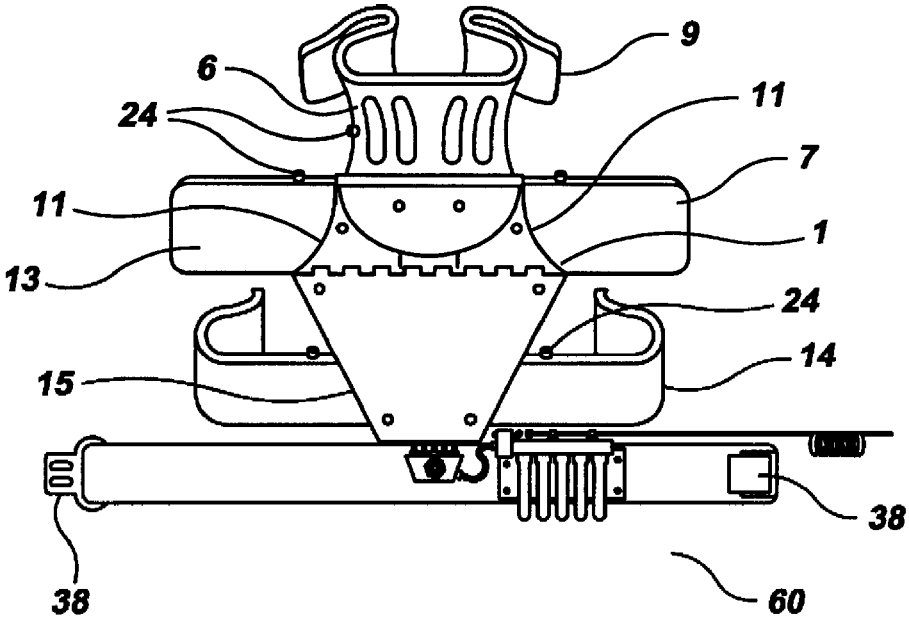
FIG. 3 is a rear view of the harness with the bladders in a deployed, inflated configuration.

The present invention relates to a protective harness for a motorcycle rider. The device comprises a back plate 1 formed of upper 2 and lower 3 hinged sections with a waist strap 4 attached to a lower end of the lower section. The waist strap includes a plurality of metal plates 37 on the inner surface thereof for protecting a wearer's lower spine from impact. The strap is secured about a wearer's waist with an aircraft style buckle 38 that can withstand substantial force. A pair of shoulder straps 5 are attached to the back plate for further securing the assembly to a wearer. An elongated gel-pad strip 35 spans substantially the entire length of the back plate to minimize any discomfort that may be caused by the rigidity thereof.

Received within the upper back plate section are a neck bladder 6 and a shoulder bladder 7. The neck bladder is deployed via an opening 8 at a top end of the upper back plate section. The neck bladder includes a collar 9 that surrounds the wearer's neck to provide a protective, supportive barrier between the shoulders and head. A guide plate 10 steers the collar into a proper position during inflation.

The shoulder bladder is deployed via two openings 11 each on an opposing side of the upper back plate section. When completely inflated, the shoulder bladder forms an elongated horizontal pad 13 across the wearer's shoulder blades.

Received within the lower back section is an inflatable rib cage bladder 14 that is deployed via each of two opposing side openings 15 on the lower back plate section. When the rib cage bladder is inflated, it forms an encompassing, protective barrier about the wearer's rib cage.

Figure 4:
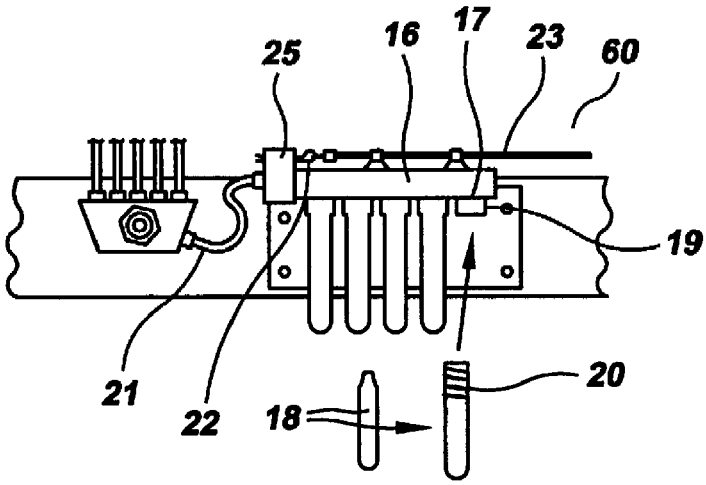
FIG. 4 is a detailed view of the CO2 distribution manifold and actuating valve.

Now referring primarily to FIG. 4, the bladders are automatically inflated and deployed with a CO2 manifold system 60 whenever a motorcycle rider is ejected from the motorcycle. A manifold 16 is attached to the waist belt having a plurality of ports 17 thereon. Each port includes a needle therein for piercing a membrane on a CO2 cannister 18. Each manifold port includes a threaded sleeve 19 for engaging a threaded neck 20 on the cannister to provide an airtight seal therebetween. A CO2 supply hose 21 establishes communication between the manifold and each of the bladders.

Gas flow from the canisters to the CO2 supply hose is normally blocked by an actuating valve 25. The actuating valve is controlled with a cotter pin 22 having a cable 23 fastened thereto. The cable is tethered to a motorcycle so that if a rider falls therefrom, the cable displaces the pin to open the valve thereby instantly delivering CO2 to the respective bladders.

Each bladder contains one or more O-ring sealed caps 24 that allow the bladders to be deflated if necessary. Additional CO2 canisters can be attached to the back plate if required to properly inflate all of the bladders.

The above described device is not limited to the exact details of construction and enumeration of parts provided herein. For example, though the inflation gas has been described as carbon dioxide, any other suitable gas may be used. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A protective harness for a motorcycle rider comprising: the harness includes a pair of shoulder straps a back plate attachable to a motorcycle rider wherein said back plate is formed of an upper section and a lower section connected to one another by a hinge;

a plurality of inflatable bladders received within said back plate; wherein said bladders include a neck bladder, a shoulder bladder and a rib cage bladder; wherein the shoulder and neck bladder are received within the upper section and the rib cage bladder is received within the lower section;

means for automatically inflating said bladders upon the motorcycle rider falling from a motorcycle to form a protective, shock absorbing barrier about the rider wherein said neck bladder includes a collar that surrounds a wearer's neck to provide a protective, supportive barrier between a rider's shoulder and head;

a guide plate is attached to said upper section for steering the collar in proper position during inflation.

2. The harness according to claim 1 wherein said means for automatically inflating said bladders upon the motorcycle rider falling from a motorcycle comprises a gas source in selective communication with each of said bladders.

3. The harness according to claim 2 wherein said gas source includes:

a manifold attached to the waist strap and in communication with said bladders, said manifold having a plurality of ports thereon, each of said ports including a needle therein;

a plurality of gas canisters, each canister attachable to one of said ports, each of said canisters having a membrane that is pierced when said cannister is attached to said port;

an actuating valve for regulating flow between said canisters and said bladders.

4. The harness according to claim 3 wherein said actuating valve is controlled with a cotter pin having a cable fastened thereto, said cable tethered to a motorcycle so that if a rider falls therefrom, the cable displaces the pin to open the valve thereby instantly delivering gas to the bladders.

5. The harness according to claim 1 further comprising a pair of shoulder straps secured to the back plate for securing the back plate to a wearer.

6. The harness according to claim 1 further comprising a waist strap attached to said back plate for further securing the back plate to a wearer.

7. The harness according to claim 1 wherein said neck bladder is deployed via an opening at a top end of the upper section of said back plate.

8. The harness according to claim 1 wherein said shoulder bladder is deployed via two openings each on an opposing side of the upper section of said back plate, said shoulder bladder forming an elongated horizontal pad across a wearer's shoulder blades when completely inflated.

9. The harness according to claim 1 wherein said rib cage bladder is deployed via each of two opposing side openings thereon, said rib cage bladder forming an encompassing, protective barrier about a wearer's rib cage when the rib cage bladder is inflated.

10. The harness according to claim 1 wherein each bladder contains at least one removable cap that is removed to deflate said bladder.

* * * * *